United States Patent [19]

Joly

[11] Patent Number: 4,593,965

[45] Date of Patent: Jun. 10, 1986

[54] ELECTRICAL CONNECTOR FOR MATING WITH THREE ORTHOGONALLY ARRANGED TABS

[75] Inventor: Jean C. Joly, Osny, France

[73] Assignee: AMP Incorporated, Harrisburg, Pa.

[21] Appl. No.: 656,633

[22] Filed: Oct. 1, 1984

[30] Foreign Application Priority Data

Sep. 29, 1983 [FR] France ..... 83 15506

[51] Int. Cl.[4] ..... H01R 33/72

[52] U.S. Cl. ..... 339/192 R; 339/176 R

[58] Field of Search ..... 339/191 R, 191 M, 191 L, 339/191 A, 191 S, 192 R, 192 RL, 176 R, 176 L

[56] References Cited

U.S. PATENT DOCUMENTS

| | | | |
|---|---|---|---|
| 2,762,026 | 9/1956 | Knohl | 339/192 R |
| 2,980,881 | 4/1961 | McKee | 339/192 R |
| 3,213,407 | 10/1965 | Thomas et al. | 339/192 R |
| 3,550,067 | 12/1970 | Hansen | 339/192 R |
| 3,643,210 | 2/1972 | Fujita | 339/192 R |
| 3,874,764 | 4/1975 | Volinskie | 339/191 R |
| 4,210,382 | 7/1980 | Culberston | 339/192 R |

FOREIGN PATENT DOCUMENTS

| | | | |
|---|---|---|---|
| 0637850 | 1/1964 | Belgium . | |
| 0021730 | 1/1981 | European Pat. Off. . | |
| 1790065 | 12/1971 | Fed. Rep. of Germany | 339/210 R |
| 1182741 | 6/1959 | France . | |
| 2232100 | 12/1974 | France . | |
| 2460553 | 1/1981 | France . | |
| 1019607 | 9/1963 | United Kingdom | 339/192 R |
| 1463591 | 7/1972 | United Kingdom . | |

*Primary Examiner*—Gil Weidenfeld
*Assistant Examiner*—Thomas M. Kline
*Attorney, Agent, or Firm*—Robert W. J. Usher

[57] ABSTRACT

An electrical connector for mating with three orthogonally arranged tabs, e.g., on an automobile head lamp base, comprises a housing having three cavities arranged in line and each receiving an electrical terminal having opposed first and second tab-engaging contacts. The terminals are identical with one another. The housing defines three tab receptacles which are also orthogonally arranged. The first contact of each terminal in each of the two cavities is engageable with a tab inserted into a respective one of two of the receptacles and the second contact of the terminal in the center cavity is engageable with the remaining tab.

9 Claims, 11 Drawing Figures

ELECTRICAL CONNECTOR FOR MATING WITH THREE ORTHOGONALLY ARRANGED TABS

This invention relates to an electrical connector for mating with three electrical tabs projecting in spaced orthogonal array, from a base, two of the tabs being in parallel planes and in opposed relation and the plane of the third tab, which tab is positioned adjacent edges of the two other tabs and between the planes of the two other tabs extending transversely thereof, the connector comprising an elongate insulating housing defining three cavities each containing an electrical terminal comprising a tab-engaging contact for making electrical connection with one of the tabs when the connector has been mated with the tabs.

This invention also relates to a terminal for such a connector.

Such an orthogonal array of tabs is typically to be found on an automobile lamp base. A know connector for mating with such tabs comprises for each tab, a terminal having a tab-engaging contact, these terminals being mounted in a housing, so configured that the terminals lie on three sides of a square. Such an arrangement of terminals entrains difficulties in machine design where the terminals are to be loaded into the housing, or where lead wires are to be connected to the terminals, by means of automated machinery. For this purpose it is preferable that the terminals are arranged in the housing in a straight line. It is also preferable that the terminals should all be identical with one another, so that they can all be produced in the same stamping and forming press and in strip form for feeding to a contact loading machine.

Although it has been proposed to arrange the terminals in line in a housing which can subsequently be flexed so as to bring the terminals into orthogonal relationship, in this case latching means must be provided for retaining the housing in its flexed position, and an additional assembly step is necessary to flex the housing to bring the terminals into the orthogonal relationship.

The present invention is intended to provide a connector for the purpose set forth above, but in which the terminals are arranged in line and are identical, but in which the housing is rigid.

According to one aspect of the invention, a connector of the type described in the second paragraph of the specification is characterised in that each terminal comprises first and second tab-engaging contacts connected together in spaced, opposed relationship, the cavities being arranged in line and the terminals all being angularly oriented in the same way with respect to the housing, which is a rigid structure, with one tab-engaging contact of each terminal adjacent to one wall of the housing and the other adjacent to the opposite wall thereof, the centre cavity communicating with the interior of the first tab receptacle formed in the one wall of the housing and each of the two end cavities communicating with the interior of respective second and third tab receptacles formed in the opposite wall of the housing, each tab contact projecting into the interior of the tab receptacle which is adjacent thereto, for engaging a tab when such has been inserted into the tab receptacle.

The connector of the invention thus avoids the requirement for the additional assembly step to flex the housing to bring the terminals into orthogonal relationship prior to mating with the tabs.

An electrical terminal according to the invention comprises three metal plates connected together to provide a substantially channel-shaped structure, each of the two plates which are opposite one another, being formed with a wire slot having a mouth opening into an edge thereof which is adjacent to the third plate, the wire slots being aligned with one another and opening in the same direction, a two-armed tab-engaging contact depending from that edge of one of the two opposite plates, which edge is remote from that into which the wire slot opens, and a single armed tab-engaging contact depending from that edge of the other of the two opposite plates, which edge is remote from that edge into which the wire slot opens, the tab-engaging contacts extending in the opposite direction to the wire slots.

For a better understanding of the invention reference will now be made by way of example to the accompanying drawings which show an embodiment of an electrical connector for mating with a three-tab automobile head lamp, and in which.

Figure 11:
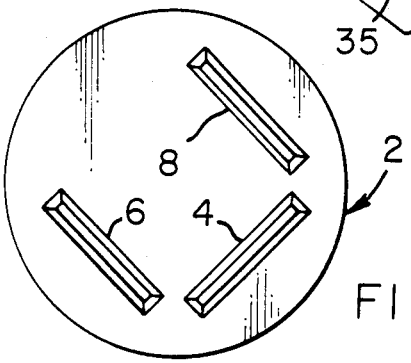
FIG. 11 is a diagrammatic plan view of the base of an automobile head lamp.

As shown in FIG. 11, the head lamp base 2 has projecting perpendicularly therefrom in a spaced orthogonal array, three flat connecting tabs 4, 6 and 8 respectively, the tabs 6 and 8 being parallel to one another aligned in opposed relation and the tab 4 being positioned between the planes of the tabs 6 and 8 adjacent the edges thereof and extending at right angles thereto.

The connector comprises a rigid insulating housing 10 moulded from plastics material and three identical electrical terminals 12 each of which has been stamped and formed from a single piece of sheet metal stock, e.g., brass stock.

Figure 3:
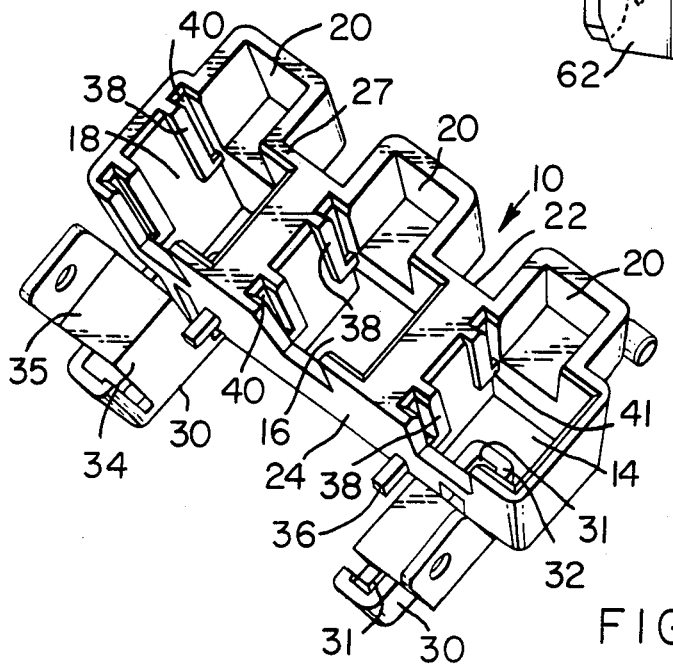
FIGS. 3, 4 and 5 are perspective views of the insulating housing of the connector, taken from above, from one end, and from below, respectively.
Figure 4:
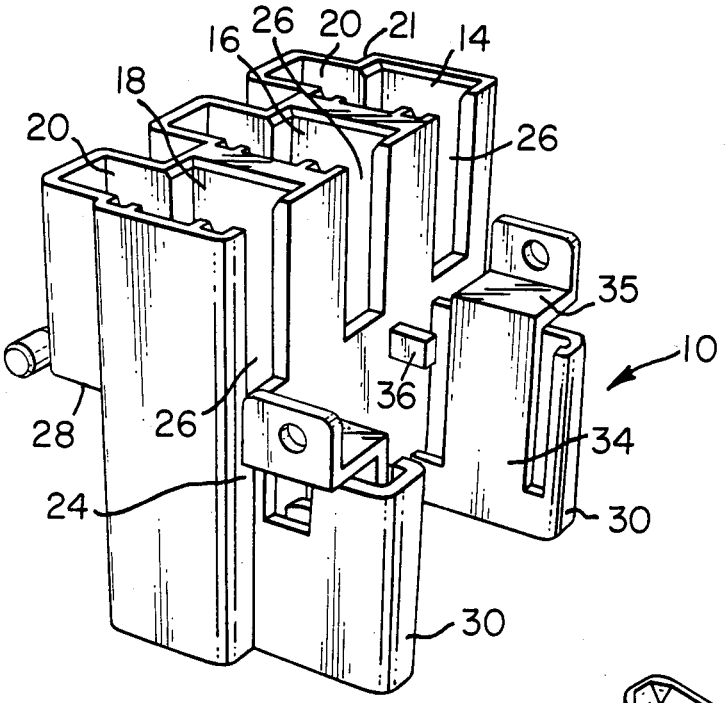

The housing 10 defines three identical, substantially rectangular cavities 14, 16 and 18, respectively arranged in line, each for receiving one of the terminals 12, and each being open at both ends and each communicating with the interior of a pocket 20 formed integrally with the upper (as seen in FIGS. 3 and 4) part of a rear wall 22 of the housing 10. Opposite to each pocket 20, a forward wall 24 of the housing 10 is formed with a rectilinear slot 26, best seen in FIG. 4, which opens into a top, wire-receiving end 27 of the housing 10 and extends therefrom down to a position level with a lower end 28 of the opposed pocket 20.

Figure 5:
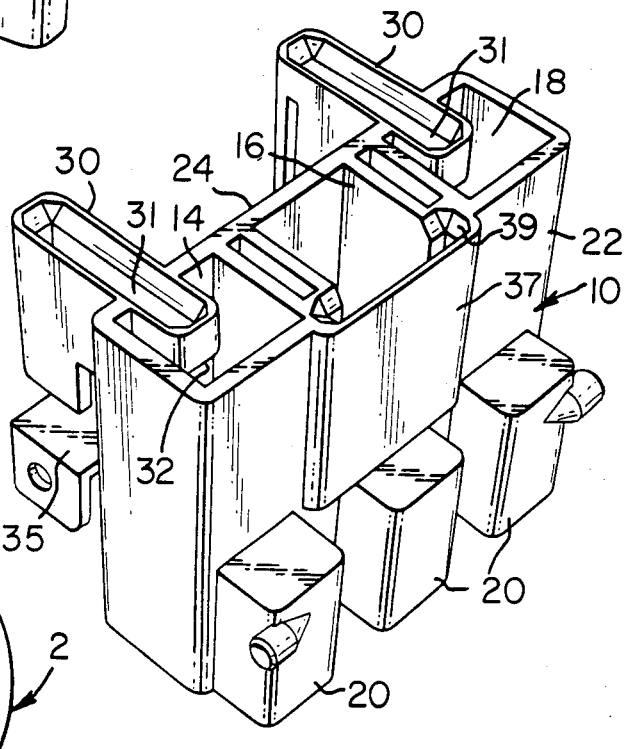
Figure 6:
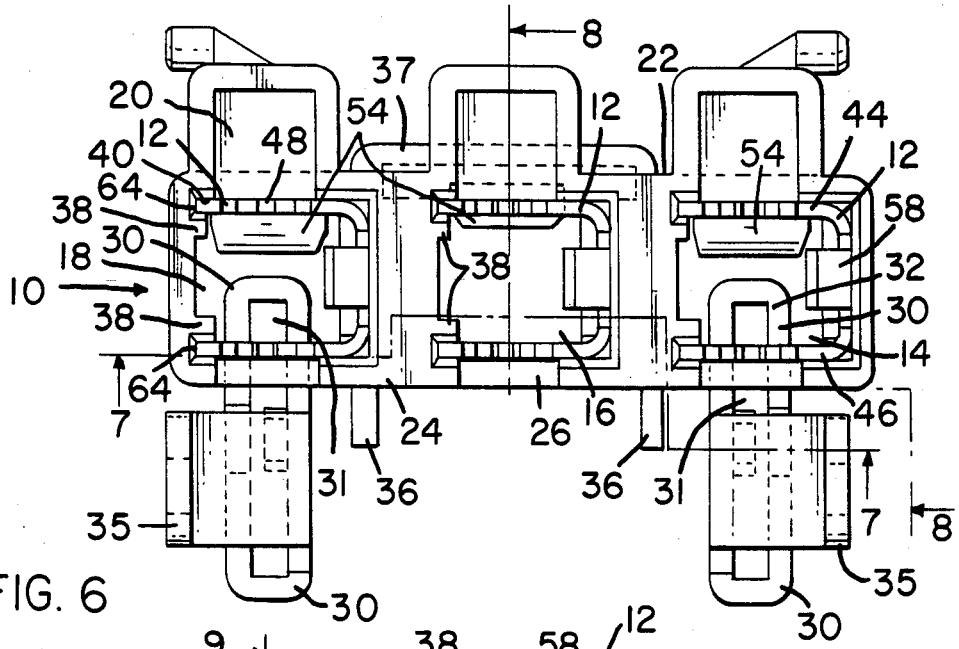
FIG. 6 is a plan view of the assembled connector.
Figure 7:
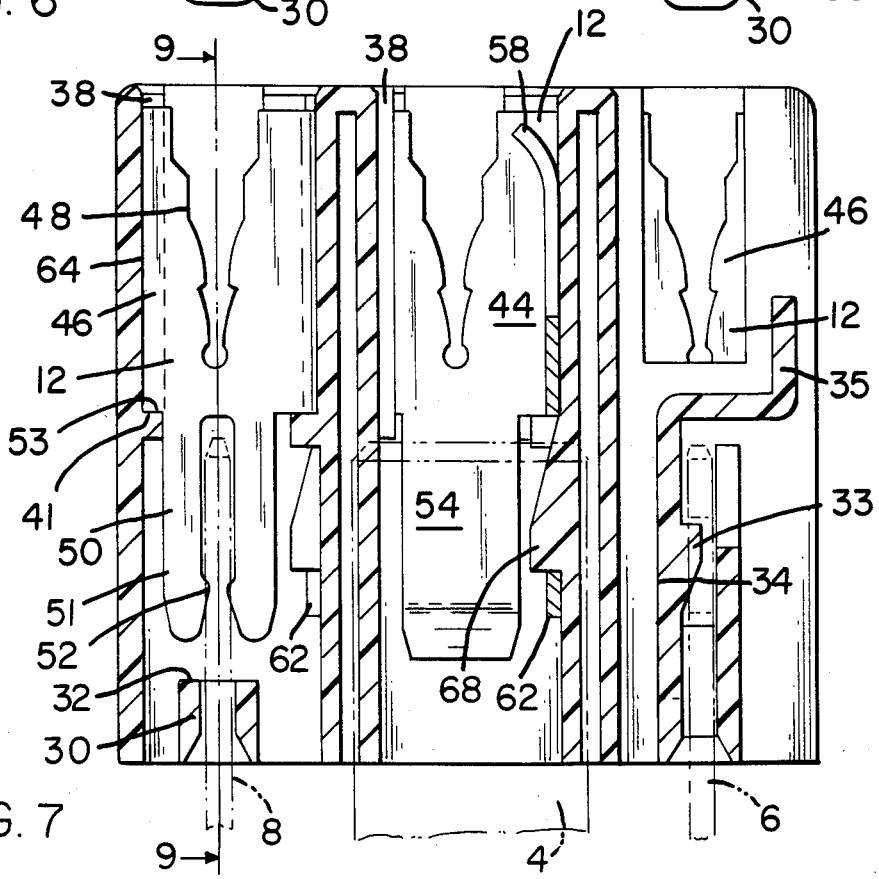
FIG. 7 is a cross-sectional view of the connector taken along line 7—7 of FIG. 6.

Projecting from, and formed integrally with, the wall 24 are two parallel tab receptacles 30, each of which protrudes into a respective one of the cavities 14 and 18, and has a cut-out 32 so that the height of each receptacle within its cavity 14 or 18 is much smaller than its maximum height outside that cavity. The receptacles 30 define tab-receiving slots 31 (FIGS. 5 and 6) which intersect the respective cavities 14 and 18. Formed integrally with each receptacle 30, outwardly of wall 24, is tab locking leaf spring member 34 formed with a catch 33 and restrained against undue flexure by a lug 36 of the receptacle 30, and having a release handle 35 extending at right angles thereto.

Figure 8:
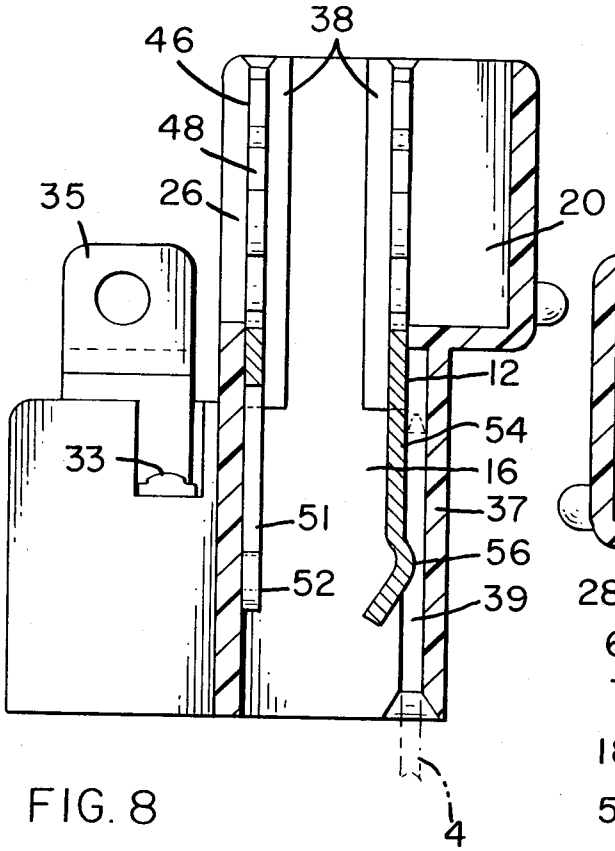
FIG. 8 is a cross-sectional view of the connector taken along line 8—8 of FIG. 6.

The cavity 16 communicates with the interior of a further tab receptacle 37 (best seen in FIGS. 5, 6 and 8) formed integrally with the wall 22 and providing a tab-receiving slot 39, extending longitudinally of the wall 22 and at right angles to the wall 24 and slots 31 and intersecting the cavity 16.

Each cavity 14, 16 and 18 has on its left hand (as seen in FIG. 3) end wall, two spaced L-shaped ribs 38 each cooperating with one adjacent wall 22 or 24 of the housing 10 to define a groove 40, which is closed at its lower (as seen in FIG. 3) end by the base 41 of the L.

Figure 10:
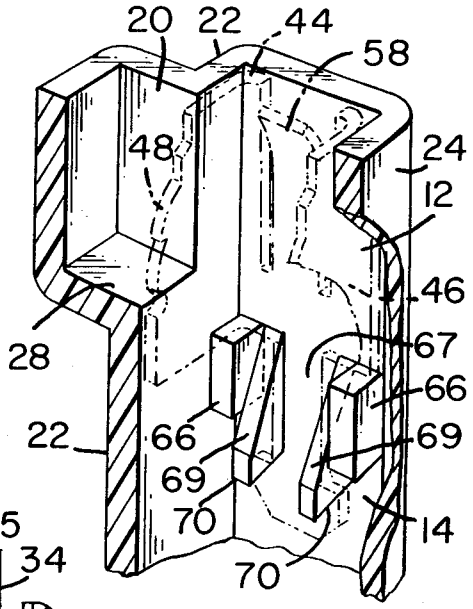
FIG. 10 is a fragmentary perspective view of one corner of the connector.
Figure 9:
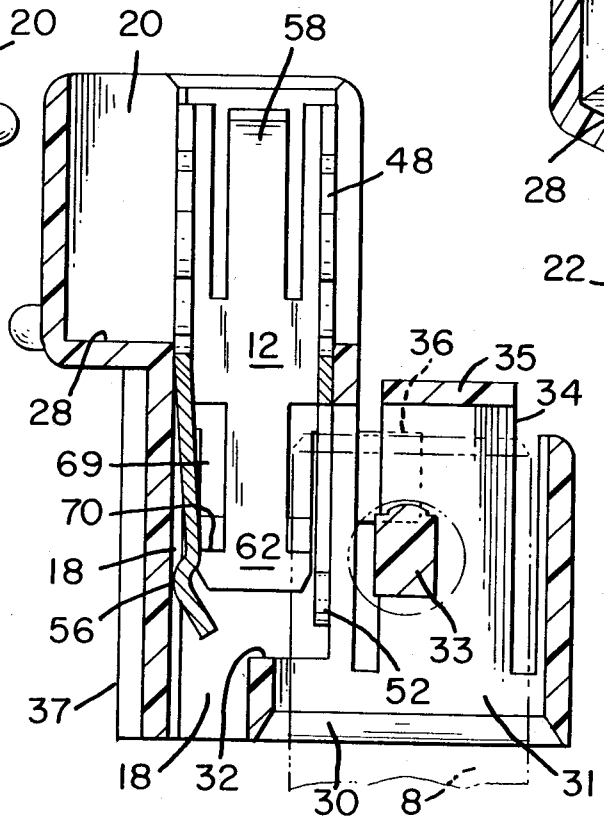
FIG. 9 is a cross-sectional view of the connector taken along line 9—9 of FIG. 7.

As best seen in FIG. 10, two support blocks 65 are provided in the corners of the right hand ends of each cavity, at the junctions of the end wall and the forward end rearward walls 22 and 24. Between the blocks extends a vertical terminal locating channel 67 defined by spaced ribs 68 having ramp surfaces 69 which project outwardly and downwardly from the end wall, their lower ends forming terminal anchoring shoulders 70.

Figure 1:
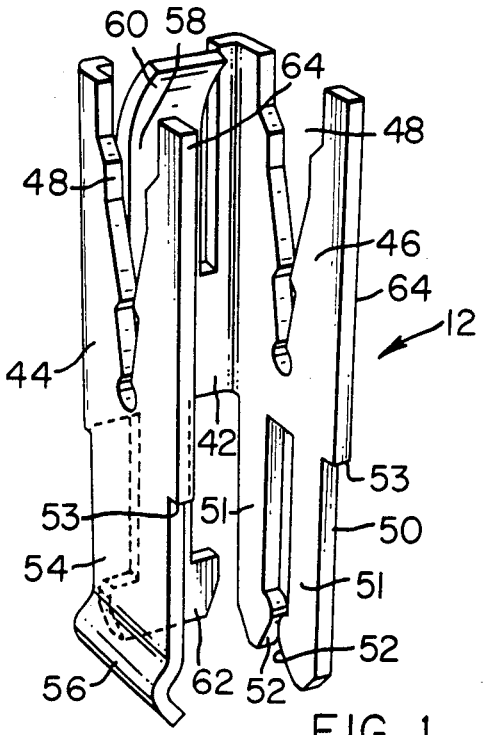
FIGS. 1 and 2 are perspective views of an electrical terminal of the connector taken from different sides.
Figure 2:
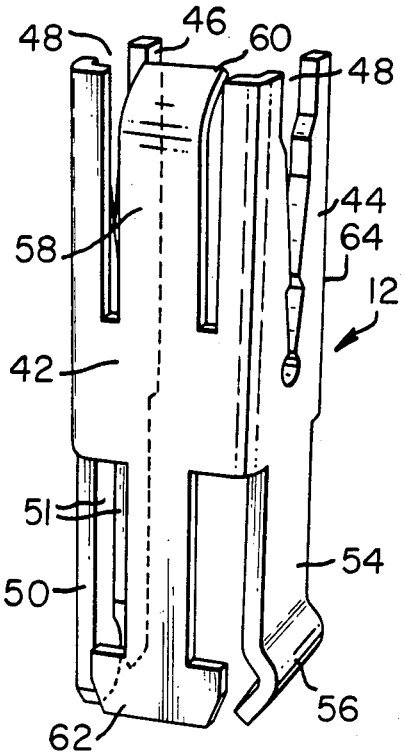

As shown in FIGS. 1 and 2, each terminal 12 is substantially U-shaped or channel-shaped, comprising a web in the form of a plate 42 and substantially parallel side plates 44 and 46, each connected to the plate 42 and each provided at its upper end with a wire slot 48 shaped according to the teaching of our French Patent Application No. 79.17039, for receiving a multistranded, insulated lead wire (not shown). There depends from the plate 46, a two-armed, tab-engaging receptacle contact 50 the arms 51 of which have contact surfaces 52 bowed towards each other for resiliently gripping a tab 6 or 8 inserted therebetween. The plate 46 presents a shoulder 53 adjacent to the root of one of the arms 51. The plate 44 has depending therefrom a one-armed tab-engaging contact 54 having a contact surface 56 which is bowed away from the receptacle contact 50. The plate 42 has, in line with the wire slots 48, an upstanding wire stuffer projection 58, the free end portion 60 of which is curved over inwardly of the terminal 12. The plate 42 is formed with a substantially T-shaped anchoring lug 62, depending therefrom, and extending in the same direction as the contacts 50 and 54.

In order to prepare the connector for use, the terminals 12 are inserted, preferably by means of an automatic machine, with their lower (as seen in FIGS. 1 and 2) ends leading and with the same angular orientations, into respective cavities 14, 16 and 18. During insertion, the free edge portions 64 of the plates 44 and 46 of each terminal each engage in one of the grooves 40 and slide therealong until the respective shoulder 53 is seated on closed end 41 of the groove 40, as the head of the lug 62 rides over the ramp surfaces 69 and engages under the shoulders 70 in a snap action with the shank received in the channel 67, to secure the terminal in position therein. The receptacle contacts 50 of the terminals 12 so positioned in the cavities 14 and 18 lie in the cut-outs 32, in alignment with the slots 31 of the receptacles 30, the planes of the contacts 50 extending at right angles to the slots 31. The contact 54 of the terminal 12 in the cavity 16 extends into the interior of the receptacle 37. In the case of each of the terminals 12, the two wire slots 48 lie in alignment with the pocket 20 and opposite the rectilinear slot 26.

In order to load the connector with insulated lead wires (not shown) one wire is inserted into each pair of wire slots 48 by means of the wire insertion tooling of an automatic wire insertion machine, so that a free end of the wire extends into the pocket 20, that part of the wire which is to be connected to the lamp switch of the automobile, extending out through the opposite slot 26. The provision of the pockets 20 and slots 26 allows the wire insertion tooling to force each wire down at right angles to its longitudinal axis into the associated wire slots 48, so that the edges of the slots pierce the insulation of the wire to make electrical connection with the metal core of the wire. The tooling is arranged at the same time to curl over the wire stuffer projection 58 of each terminal 12 down onto that portion of the wire which extends between the two wire slots 48 of the terminal 12 so that the wire is held down in the wire slots.

In order to mate the connector with the head lamp base 2, the tabs 6 and 8 thereof are inserted into respective slots 31 of the receptacles 30, the tab 4 being inserted into the slot 39 of the receptacle 37, whereby the tabs 6 and 8 are gripped between the contact surfaces 52 of the contacts 50 of the terminals 12 in the cavities 14 and 18 and the tab 4 is resiliently engaged by the contact surface 56 of the contact 54 of the terminal 12 in the cavity 16. The connector can be detached from the head lamp by pressing the handles 35 towards one another and pulling the connector away from the head lamp base 2.

An advantage of the connector described above is that the terminals are all arranged in line and in the same angular orientation with respect to the housing, so that they can readily be terminated by means of a conventional automatic wire insertion machine. Also, the terminals are identical so that they can be produced by the same stamping and forming press, preferably in the form of a strip of terminals for supply to conventional automatic apparatus for loading the terminals into the housing. The fact that all the terminals are to be angularly oriented in the same way with respect to the housing facilitates the loading operation.

I claim:

1. An electrical connector for mating with three electrical tabs projecting in spaced orthogonal array from a base, two of the tabs being in parallel planes and opposed relation and the plane of the third tab, which tab is positioned adjacent edges of the two other tabs and between the planes of the two other tabs, extending transversely thereof; the connector comprising an elongate insulating housing defining three cavities each containing an electrical terminal comprising a tab-engaging contact for making electrical connection with one of the tabs when the connector has been mated with the tabs; characterised in that each terminal comprises first and second tab-engaging contacts connected together in spaced, opposed relationship, the cavities being arranged in line and the terminals all being angularly oriented in the same way with respect to the housing, which is a rigid structure, with one tab-engaging contact of each terminal adjacent to one wall of the housing and the other adjacent to the opposite wall thereof, the centre cavity communicating with the interior of a first tab receptacle formed in the one wall of the housing and each of the two end cavities communicating with the interior of respective second and third tab receptacles formed in the opposite wall of the housing, each tab contact projecting into the interior of the tab receptacle which is adjacent thereto, for engaging a tab when such has been inserted into the tab receptacle.

2. A connector according to claim 1, characterised in that the first tab receptable provides a tab-receiving slot which extends longitudinally of the one wall and which intersects the centre cavity, each of the second and third tab receptacles providing a tab-receiving slot which extends at right angles to the opposite wall and interacts the associated cavity.

3. A connector according to claim 1, characterised in that each of the second and third tab receptacles has, formed integrally therewith, a tab retaining spring member which is located outwardly of the opposite wall and which is provided with a tab release handle.

4. A connector according to claim 1, characterised in that each tab contact depends from a plate which is connected to a web and which has a free edge portion remote from the web, each such free edge portion being received in a groove formed in a wall of the respective cavity, a shoulder intermediate each plate and the tab contact extending therefrom, resting on a closed end of the respective groove.

5. A connector according to claim 4, characterised in that each plate is formed with a wire slot opening in a direction away from the tab contact extending from the plate, the one wall of the housing being formed with pockets each communicating with a respective cavity, and the opposite wall of the housing being formed with openings, each of which is aligned with a respective pocket and with the two wire slots of the terminal in the cavity, each pocket and each opening, debouching into a wire-receiving end of the housing:

6. A connector according to claim 5, characterised in that the web of each terminal is provided with a wire stuffer projection which can be curled over inwardly of the terminal to engage a portion of a wire extending between the wire slots of the terminal.

7. A connector according to claim 1, characterised in that one tab-engaging contact of each terminal has a pair of arms for receiving a tab between them, the other tab-engaging contact of each terminal being in the form of a single arm having a tab contact surface which is bowed in a direction away from the one tab-engaging contact, the one tab-engaging contact of each terminal in one of the two end cavities being aligned with the respective second and third tab receptacle, the bowed contact surface of the other tab-engaging contact of the terminal in the centre cavity protruding into the first tab receptacle.

8. An electrical terminal for a connector according to claim 1, characterised in that it comprises three metal plates connected together to provide a substantially channel-shaped structure, each of the two plates which are opposite one another, being formed with a wire slot having a mouth opening into one edge thereof which is adjacent to the third plate, the wire slots being aligned with one another and opening in the same direction, a two-armed tab-engaging contact depending from another edge of one of the two opposite plates, which other edge is remote from the one edge, and a single-armed tab-engaging contact depending from an edge of the other of the two opposite plates, which edge is remote from the one edge into which the wire slot opens, the tab-engaging contacts extending in the opposite direction to the wire slots.

9. A terminal according to claim 8, characterised in that the third plate is provided with a wire stuffer projection having a free end portion which is curved inwardly of the terminal and which is substantially level with the mouths of the wire slots, a substantially T-shaped anchoring lug extending from the third plate in the same direction as the tab contacts.

* * * * *